US005823112A

United States Patent [19]

Platsch

[11] Patent Number: 5,823,112

[45] Date of Patent: Oct. 20, 1998

[54] POWDER-DUSTING APPARATUS

[75] Inventor: Hans Georg Platsch, Stuttgart, Germany

[73] Assignee: Grafix Zerstaubungstechnik GmbH, Germany

[21] Appl. No.: 860,765

[22] PCT Filed: Oct. 25, 1996

[86] PCT No.: PCT/EP96/04635

§ 371 Date: Jul. 12, 1997

§ 102(e) Date: Jul. 12, 1997

[87] PCT Pub. No.: WO97/21545

PCT Pub. Date: Jun. 19, 1997

[30] Foreign Application Priority Data

Dec. 14, 1995 [DE] Germany ..... 195 46 720.5

[51] Int. Cl.[6] ..... B41F 23/06

[52] U.S. Cl. ..... 101/424.2

[58] Field of Search ..... 101/424.2, 424.1

[56] References Cited

U.S. PATENT DOCUMENTS

| | | | |
|---|---|---|---|
| 1,555,797 | 9/1925 | Grammer | 101/424.1 |
| 4,332,198 | 6/1982 | Schmoeger | 101/424.2 |
| 4,449,453 | 5/1984 | Staffer et al. | 101/424.1 |
| 4,807,528 | 2/1989 | Schmoeger et al. | 101/424.2 |
| 5,001,980 | 3/1991 | Aoki et al. | 101/424.2 |

FOREIGN PATENT DOCUMENTS

| | | |
|---|---|---|
| 0 375 799 | 7/1990 | European Pat. Off. . |
| 0 555 073 | 8/1993 | European Pat. Off. . |
| 41 07 146 | 9/1991 | Germany . |

*Primary Examiner*—Edgar S. Burr
*Assistant Examiner*—Amanda B. Sandusky

[57] ABSTRACT

A powder-dusting apparatus (4) which inside a printing machine dusts the pre-dried printed products coming from the printing unit with a powder, for example of corn-starch, comprises in a manner known per se a plurality of nozzles (6), which are charged with a mixture of powder and carrying air from a mixing device (8). The nozzles (6) are arranged in the vicinity of the plane of transport defined by the transport system (1) of the printing machine and are able to assume two different spacings with respect to that plane: ordinarily the nozzles (6) are located comparatively close to this plane of transport; during these times the mixture of powder and carrying air emerges from the nozzles (6) towards the printed products moving past. If, however, a gripping device (2), which is part of the transport system (1) and which holds the printed product, enters the vicinity of the nozzles (6), a suitable control means (9 to 12) causes the nozzles to move into a second position. In this position there is between the underside of the nozzles (6) and the plane of transport of the transport system (1) sufficient space for the gripping device (2) to be able to pass.

14 Claims, 5 Drawing Sheets

POWDER-DUSTING APPARATUS

This is a 371 of PCT/EP96/04635, filed on Oct. 25, 1996.

The invention relates to a powder dusting apparatus for a printing machine, having a) a plurality of nozzles through which a mixture of powder and carrying air is directed towards the printed products moved past by gripping devices of the transport system of the printing machine;

b) a mixing device, in which the powder is mixed with air to produce the mixture of powder and carrying air;

c) at least one connecting line, which connects the mixing device with the nozzles.

Powder-dusting apparatuses of that kind serve to provide printing machine products which are coming from the print unit and which have passed through a drying zone with a coating of powder, which prevents the printed products from sticking together during the stacking operation that follows. For that purpose the powder-dusting apparatuses are arranged in the vicinity of the plane of transport of the printed products so that their nozzles are able to apply a mixture of air (carrying air) and powder to the printed products. Generally speaking, the transport systems of printing machines are formed by parallel endless conveyor chains which are joined to one another by a plurality of gripping devices. The gripping devices comprise a gripping mechanism, which is able to hold the printed products at their edge, and project beyond the plane of transport of the printed products. In known powder-dusting apparatuses, the nozzles therefore have to be a comparatively large distance from the plane of transport so that the gripping devices are able to get past. This large distance has the disadvantage, however, that the mixture of powder and carrying air that is expelled from the nozzles spreads out uncontrollably in the printing machine.

It is the aim of the present invention to construct a powder-dusting apparatus of the kind mentioned in the introduction in such a manner that the mixture of powder and carrying air can be applied in a spatially concentrated manner to the printed products.

That problem is solved according to the invention by d) a lifting device which is able to move the nozzles back and forth between two positions, namely, da) a first position comparatively far removed from the plane of transport of the printed products and db) a second position lying comparatively close to the plane of transport of the printed products, and e) a control means detecting the position of the gripping devices, which control means co-operates with the lifting device such that the latter brings the nozzles into the first position as long as gripping device is in the vicinity of the nozzles, and brings the nozzles into the second position when the gripping device is located an adequate distance from the nozzles.

According to the invention, the nozzles of the powder-dusting apparatus are therefore no longer fixedly mounted. On the contrary, they are given a mobility perpendicular to the plane of transport of the printed products so that they are able to "make way" for gripping devices approaching them, that is, maintain a correspondingly large distance from the plane of transport in the comparatively short period in which the gripping devices travel past beneath the nozzles. As soon as the gripping device has passed the nozzles, however, these return to a position in which they are very close to the plane of transport and thus to the surfaces of the printed products to be dusted. The proximity of the nozzle openings to the printed products allows a more controlled dusting than was previously possible with known powder-dusting apparatuses.

The lifting device and the control means alike can be realised in many different ways. In a first exemplary embodiment of the invention, both lifting device and control means are mechanically constructed and combined with one another. They are distinguished in that the lifting device and the control means are combined in a cam mechanism which comprises:

a) at least one chain wheel co-operating with a conveyor chain of the transport system;

b) at least one inherently closed cam surface carried by the chain wheel;

c) at least one cam follower connected to the nozzles, which co-operates with the cam surface;

d) a guide means, which guides the nozzle on the path between its two positions.

In this practical form, the relative position of the gripping devices on the transport system and the nozzles is mechanically detected; the lifting mechanism requires no special driving means and the control means requires no power supply of its own. This exemplary embodiment is especially robust and not susceptible to faults.

It is preferred therein that two parallel cam surfaces are provided, which form a cam track in which the cam follower is received. The two parallel cam surfaces guide the cam follower in both possible directions of movement, so that the latter is able to fulfil its function without the assistance of further components.

Alternatively, however, a form in which only one cam surface is provided and the cam follower is pressed by a biassing device against the one cam surface is perfectly possible and structurally somewhat more simple. In this practical form of the invention movement of the nozzles in one direction is therefore effected under the influence of the cam surface, which presses the nozzles back against the action of the biassing device, whilst movement in the other direction is effected by the biassing device, which holds the cam follower of the nozzles in contact with the (backwardly moving) cam surface.

In principle it is possible, however, and in many cases also easier, for the lifting device to be separated mechanically from the control means. The latter can then also be of electrical/electronic construction without problems. For that purpose it can comprise a first sensor which is arranged at the plane of transport and which, as a gripping device approaches the nozzles, gives to the lifting device a first signal which causes the lifting device to bring the nozzle into the first position. The sensor can be any device which responds to the physical proximity of the gripping device, for example, all forms of proximity switches, light barriers, alternatively also mechanical switches of which the operating element is operable by the gripping devices as these move past. The "restoration" of the nozzles into the (second) position close to the plane of transport can here in turn be effected by different methods:

It is thus possible, for example, for the control means to comprise a second sensor which is arranged at the plane of transport and which, as a gripping device moves away, gives a second signal to the lifting device which causes the lifting device to bring the nozzle into the second position.

Alternatively, a form of the invention is possible in which the control means contains a timing element which is triggered by the first signal of the first sensor and after a certain period has elapsed emits a second signal which is supplied to the lifting device and causes this to bring the nozzles into the second position. This variant is likely on the whole to be less expensive than the above-mentioned control means operating with two sensors. The period defined by the timing element between the appearance of the first and the second signal is selected so that it is sufficient to allow the gripping device to pass by the nozzles at the particular speed of the transport system.

Depending on the structural circumstances of the individual case, one of the two following variants, namely, the combination of the nozzles to form a nozzle assembly, can prove especially favourable.

The first variant is distinguished in that the nozzles are rigidly connected to a distributer pipe and with this form a movable unit which is connected by way of a flexible hose to the mixing duct. This variant manages with a single flexible hose, which is advantageous in respect of use of material and in respect of installation costs. Nevertheless a distributer pipe rigidly connected to the nozzle generally also means a somewhat larger moving mass.

If the size of the moving mass is of prime importance, then a practical form of the invention can be selected in which the nozzles are connected by means of a light-weight supporting bar to form a movable unit and each nozzle is connected by way of a flexible hose to a fixed distributer pipe, which in its turn is in connection with the mixing device. In this embodiment the distributer pipe is therefore not moved with the nozzles; the cohesion of the nozzle assembly which combines the different nozzles to form a whole, is effected by means of the supporting bar, which can be very much lighter in weight than a distributer pipe. In this case, however, a connection has to be made between each nozzle and the distributer pipe by way of a flexible hose.

Especially preferred is an embodiment of the invention which comprises a sensor which detects the position of the nozzles and produces an output signal that causes the mixing device to function only for as long as the nozzles are located in the second position (close to the plane of transport). Dusting is therefore interrupted for as long as the nozzles are lifted into the first position for passage of a gripping device; this enables the abovementioned disadvantages, which are found in known powder-dusting apparatuses, to be avoided also in these intervals.

The lifting device can be especially simply controlled when it displaces the nozzles in a pivoting movement between the two positions.

This can be realised in structural terms in that the lifting device comprises a one-armed or multi-armed lever which at a first point carries the nozzles and at a second point is driven by a cam surface.

The cam surface serving to move the nozzles between the two positions is advantageously constructed and driven so that one revolution of the cam surface corresponds to the advancement of the transport system of the printing machine by the spacing of two successive gripping devices.

This synchronisation of the cam surface movement with the movement of the printed products can be realised especially easily in that the circumference of a chain wheel driving the cam surface is selected to be the same as the spacing of successive gripping devices of the transport system.

Exemplary embodiments of the invention are explained in greater detail hereinafter with reference to the drawings, in which.

Figure 1:
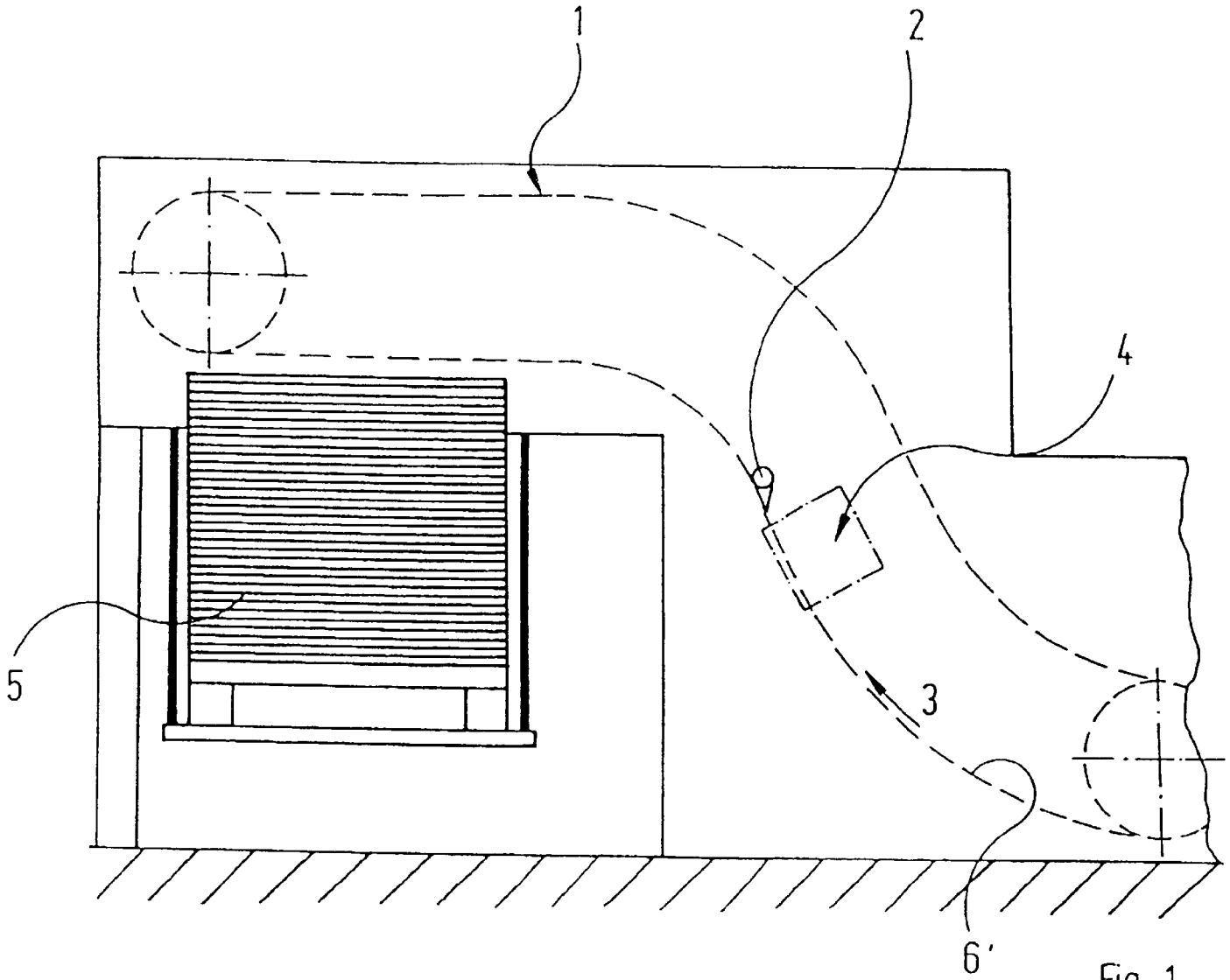
FIG. 1 shows diagrammatically the delivery region of a printing machine.

FIG. 1 illustrates the delivery region of a printing machine. The actual printing unit is imagined to be to the right of the illustrated region. The printed products are moved through the entire printing machine by means of a conveyor system, which comprises two endless conveyor chains 1. The conveyor chain 1 visible in FIG. 1 lies behind the plane of projection; a corresponding endless conveyor chain 1, running parallel to the illustrated conveyor chain 1, is mounted in front of the plane of projection of FIG. 1. The two conveyors chains 1 are connected to one another by a plurality of gripping devices 2, which extend perpendicular to the plane of projection of FIG. 1 and on each of which a gripping mechanism for gripping a printed product is mounted. The construction of such gripping devices 2 is known per se.

The gripping devices 2 are arranged at regular intervals apart along the conveyor chains 1 and transport the printed products from the intake region of the printing machine, not illustrated, through the printing unit, also not illustrated, and then in the direction of arrow 3 past a powder-dusting apparatus 4, indicated merely diagrammatically in FIG. 1, to a pile 5, on which they are deposited.

Between the printing unit and the powder-dusting apparatus 4, there is generally a drying zone, in which the printed products, still damp from printing, are substantially dried off, for example, in the region of the conveyor path denoted by the reference number 6'. Since the printed products in the drying zone, the length of which has to be kept within limits for reasons of economy, are not dried so completely that mutual adhesion is excluded, the powder-dusting apparatus 4 is provided, with which a coating of powder is applied to the printed products. This prevents the superimposed printed products from sticking to one another in the pile 5.

Figure 2:
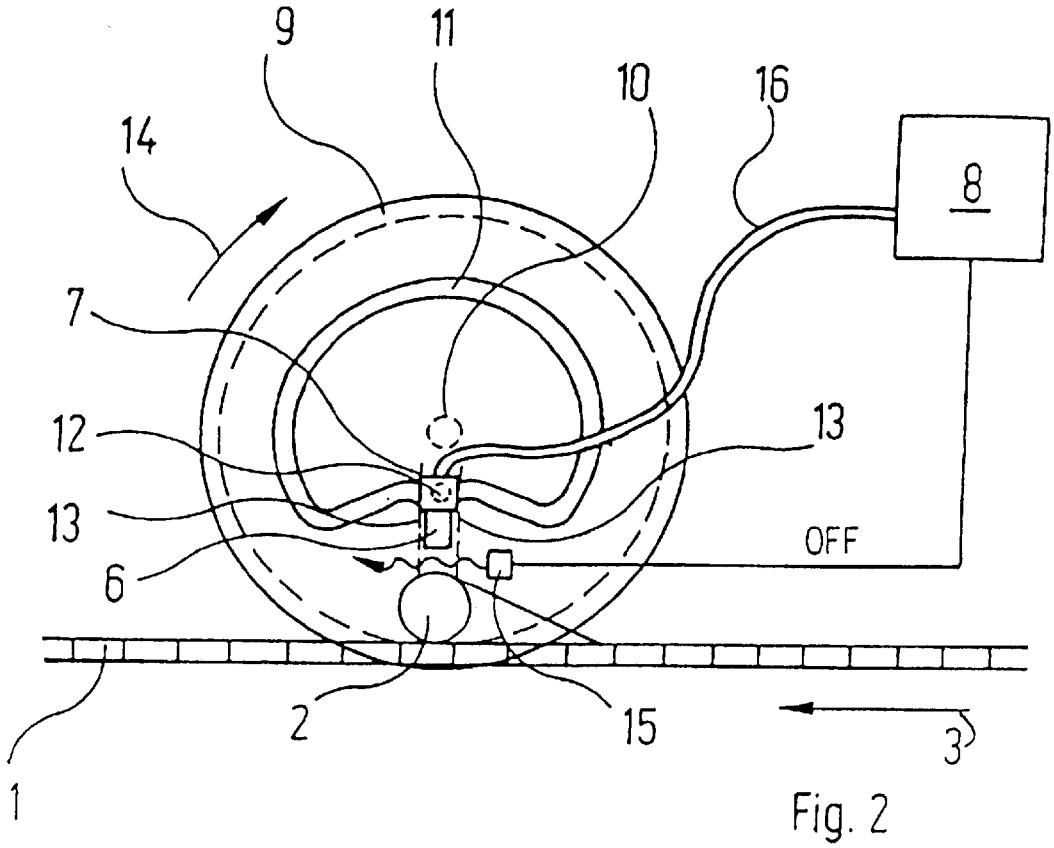
FIG. 2 shows, likewise diagrammatically, a powder-dusting apparatus provided in the printing machine of FIG. 1 in a first position of the nozzles.
Figure 3:
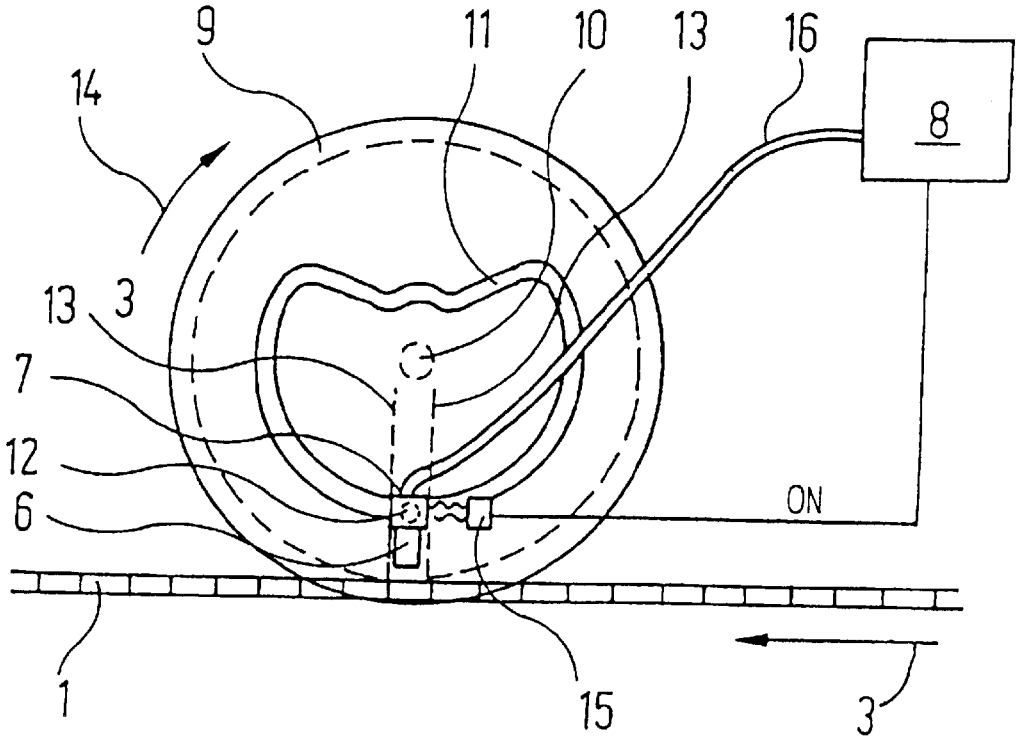
FIG. 3 is a view corresponding to FIG. 2, but in which the nozzles are located in a second position.

An exemplary embodiment of such a powder-dusting apparatus 4 is illustrated in FIGS. 2 and 3 on an enlarged scale. A plurality of nozzles 6, which are fed by way of a common distributer pipe 7, is installed at the plane of transport of the printed products moved past by means of the conveyor chains 1. The distributer pipe 7 is connected by way of a flexible hose 16 to a mixing device 8 in which the powder, generally a corn-starch product, is mixed with carrying air and is thus conveyed to the nozzles 6.

A chain wheel 9 is rotatably mounted by means of an axle stub 10 in the machine housing, which is not illustrated specifically, and engages with the transport chain 1, which in FIGS. 2 and 3 is moved behind the plane of projection in the direction of arrow 3.

The circumference of the chain wheel 9 corresponds to the spacing at which the gripping devices 2 are carried by the conveyor chains 1.

Figure 4:
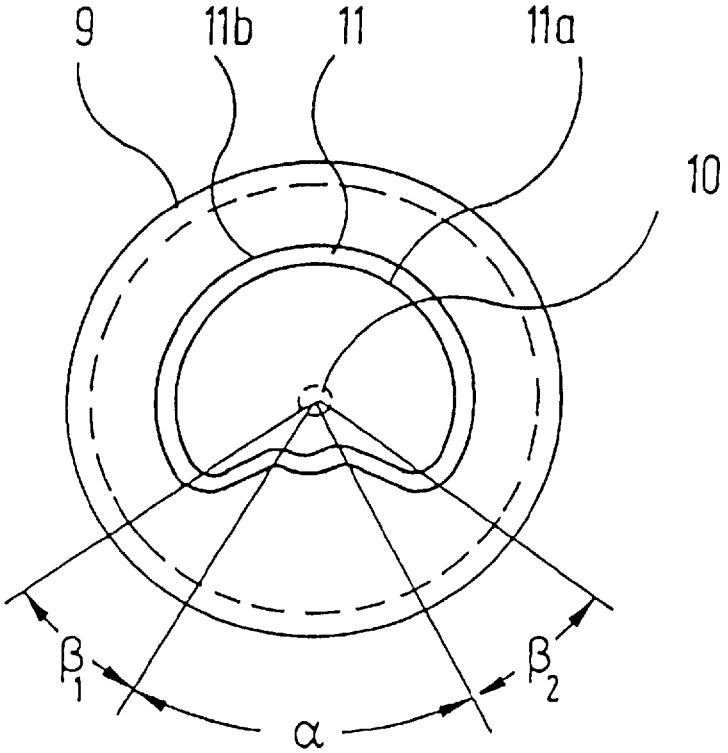
FIG. 4 is a view of a chain wheel bearing a cam track which is used in the powder-dusting apparatus of FIGS. 2 and 3.

As is especially apparent from FIG. 4, in the chain wheel 9 on the side facing towards the distributer pipe 7 there is formed a cam track 11 which comprises cam surfaces 11*a*, 11*b* running parallel to one another. The form of the cam track 11 is as follows:

For a comparatively small angle $\alpha$ the cam track 11 follows an arc of a circle which is concentric with the centre of rotation of the chain wheel 9 and has a comparatively small radius. Adjoining the angle region $\alpha$ on each side over angles $\beta_1$, and $\beta_2$ are transition regions in which the cam track 11 changes from the smaller radius to a larger radius. For the remaining angle region the cam track 11 follows an arc of a circle which is likewise concentric with the centre of rotation of the chain wheel 9, but has a larger radius.

The distributer pipe 7 is provided with a pin 12 projecting in the axial direction and serving as cam follower, which engages in the cam track 11. The distributer pipe 7, and thus the nozzles 6, are displaceable in a vertical direction between two guides 13, which are indicated in the drawing by broken lines. The arrangement is therefore such that the vertical position of the nozzles 6 is determined by the cam track 11, ultimately therefore by the rotated position of the chain wheel 9.

The spacing of two successive gripping devices 2 on the transport chain 1 corresponds to the circumference of the chain wheel 9, respectively to an integral multiple thereof. The chain wheel 9 is mounted so that the cam track 11 in the angle region $\alpha$, in which it follows the arc of the circle of relatively small diameter, is located in engagement with the cam follower 12 of the distributer pipe 7 as a gripping device 2 is passing beneath the nozzles 6.

The powder-dusting apparatus 4 described above operates as follows:

As long as there is no gripping device 2 in the vicinity of the nozzles 6, as illustrated in FIG. 3, the cam follower 12 on the distributer pipe 7 is located in the region of the cam track 11 of larger radius. This means that the distributer pipe 7 with the nozzles 6 attached thereto is lowered comparatively far down between the guides 13. The openings of the nozzles 6 are located comparatively close to and opposite the printed products being moved past in the plane of transport defined by the conveyor chains 1. That means that the mixture of powder and carrying air which emerges from the nozzles 6 has only comparatively little opportunity to escape laterally.

Shortly before the next gripping device 2 approaches the nozzles 6, the transition region of the cam track 11*b*, which corresponds to the angle $\beta^1$ (FIG. 4) and which leads in the direction of rotation (arrow 14) of the chain wheel 9, comes into engagement with the cam follower 12 so that the distributer pipe 7 together with the nozzles 6 is raised during the rotation of the chain wheel 9 through the angle $\beta_1$. Distributer pipe 7 and nozzles 6 remain in this raised position, which is illustrated in FIG. 2, for the period in which the chain wheel 9 passes through the angle $\alpha$. Within this period the gripping device 2 moves on beneath the nozzles 6 for which there is sufficient space by virtue of the comparatively large distance between the nozzles 6 and the plane of transport defined by the conveyor chains 1. Once the gripping device 2 has passed through, the cam follower 12 of the distributer pipe 7 enters the transition region of the cam track 11 in the chain wheel 9 which is associated with the lagging angular region $\beta_2$. In that region the cam follower 12, and thus the distributer pipe 7 and the nozzles 6 attached thereto, is transferred again into the region of the cam track 11 which has the larger radius. This transfer of the cam follower 12 is accompanied by lowering of the distributer pipe 7, displaceable between the guides 13, and of the nozzles 6 into the position illustrated in FIG. 3.

As a result, the conditions are such that the nozzles 6 pull back briefly from the transport plane of the printed products in order to allow a gripping device 2 to pass, and immediately thereafter return to a position adjacent to the plane of transport again.

In FIGS. 2 and 3, at the level which the distributer pipe 7 and the nozzles 6 assume in the lowered position, above the plane of transport of the printed products, a sensor 15 is provided, which detects the presence of the lowered distributer pipe 7 and the lowered nozzles 6. In the case of the exemplary embodiment of the sensor 15 illustrated in the drawing, the sensor is a reflected light barrier. Equally well suited, however, are all types of proximity switches or a mechanical micro-switch, the operating element of which lies in the path of movement of the nozzles 6 or of a component moving together with these.

If the nozzles 6 and the distributer pipe 7 are lowered, the sensor 15 supplies a starting signal to the mixing device 8. The mixing device 6 then conveys the mixture of powder and carrying air though the flexible hose 16 to the distributer pipe 7 from which is emerges by way of the nozzles 6 towards the printed products. If, however, the sensor detects that, as illustrated in FIG. 2, the nozzles 6 and the distributer pipe 7 have been raised for passage of a gripping device 2, it supplies a switch-off signal to the mixing device 8, so that no powder is blown out of the nozzles 6 during that time.

Figure 6:
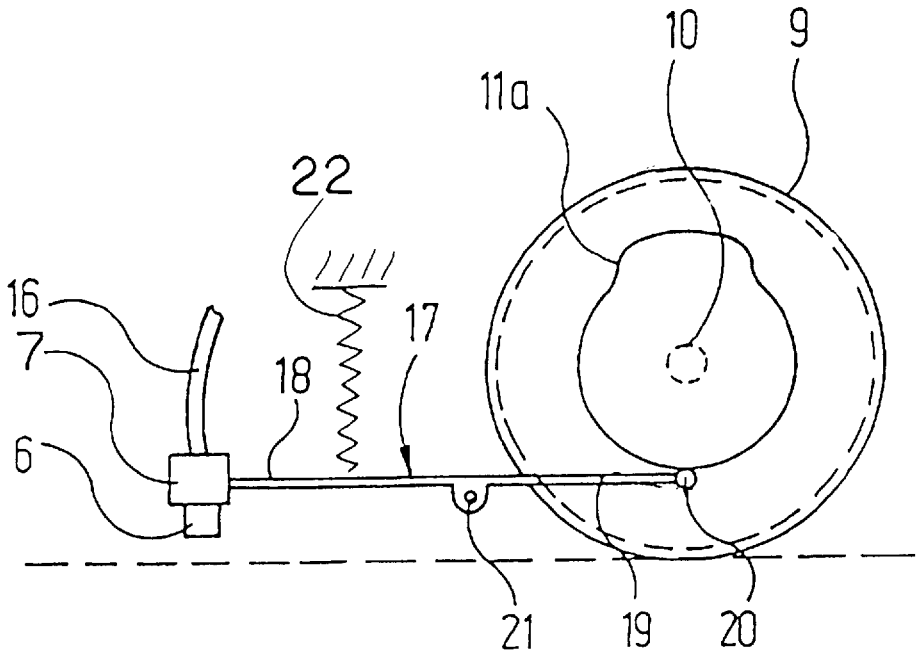

In the exemplary embodiment illustrated in FIGS. 2 to 4, the cam arrangement which effects raising and lowering of the nozzles 6 is in the form of a cam track 11 with two oppositely disposed cam surfaces 11*a* and 11*b*. The cam follower 12 is therefore positively guided between the two cam surfaces 11*a* and 11*b* both in an upward direction and in a downward direction. In the case of the embodiment shown in FIG. 6, on the other hand, only the (inner) cam surface 11*a* arranged closer to the midpoint of the chain wheel 9 is provided. The nozzles 6 and the distributer pipe 7 are urged upwards by a biassing device, for example, a spring 22, so that the cam follower 12 remains constantly in engagement with that one cam surface 11*a* even without guidance from a counter-element.

Figure 7:
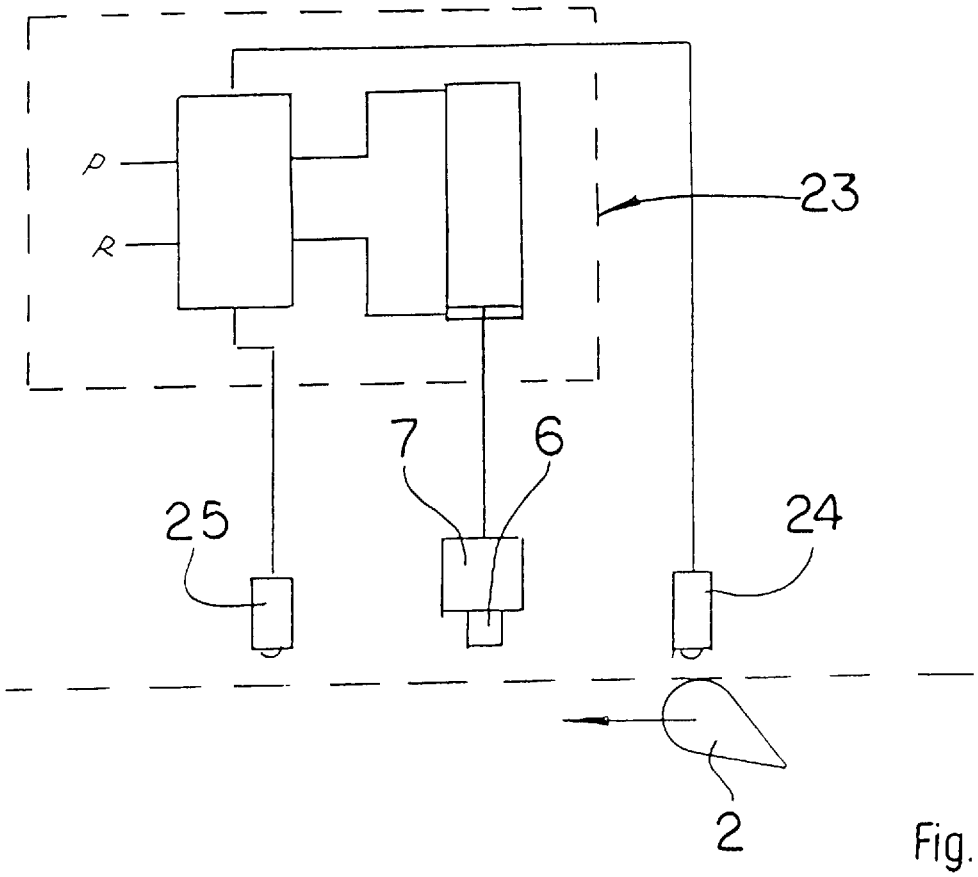
Figure 8:
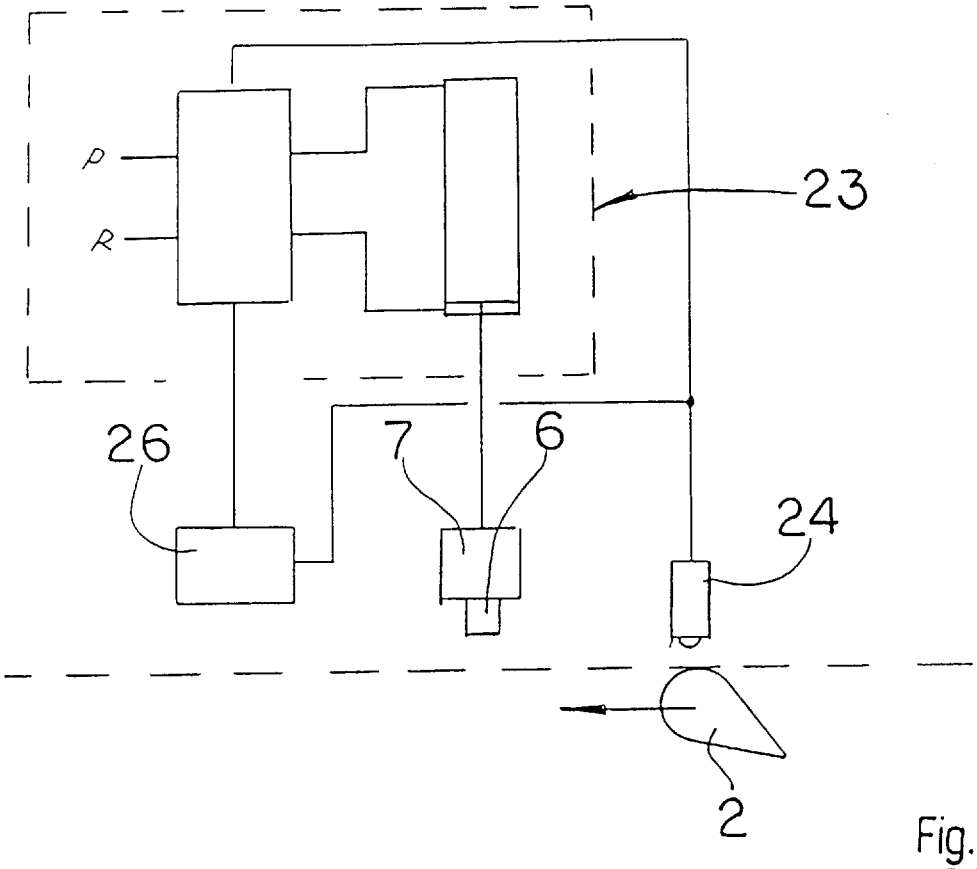

In a further embodiment of the powder-dusting apparatus 4 shown in FIG. 7, control of the lifting and lowering movement is effected electronically. To that end the distributer pipe 7 with the nozzles 6 is secured to a pneumatic cylinder 23 or a different lifting drive (for example, a magnetic drive) which is capable of moving distributer pipe 7 and nozzle 6 vertically up and down between two positions. The approach of a gripping device 2 towards the nozzles 6 is detected by a first sensor 24, for example, a (reflected) light barrier. This first sensor 24 then supplies a first signal to the lifting device 23 which thereupon moves the nozzles 6 and the distributer pipe 7 into the upper position. When the gripping device 2 has moved past the nozzles 6, it passes through a second sensor 25 which can be of similar construction to the first sensor 24. As the gripping device 2 passes, this second sensor 25 supplies a second signal to the lifting device 23, whereupon the latter returns the nozzles 6 and the distributer pipe 7 into the position adjacent to the transport plane of the printed products again. In this embodiment, the sensors 24,25 which act on the lifting device can also be used to switch the mixing device 8 on and off. Instead of two sensors, 24,25 one of which is arranged upstream of the nozzles and the other of which is arranged downstream of the nozzles 6 (viewed in the direction of transport), it is also possible to use just a single sensor 24 positioned upstream of the nozzles as shown in FIG. 8. The first signal that this sensor 24 produces as a gripping device 2 moves past is supplied not only to the lifting device 23 (which moves the nozzles 6 and 7 upwards), but also to a timing element 26. After elapse of a specific time within which the gripping device 2 has moved past the nozzles 6, the timing element produces a second signal which commands the lifting device 23 to lower the nozzles 6 and the distributer pipe 7 downwards again. It is also possible in that case to utilise the sensor signal and the output signal of the timing element 26 to control the mixing device 8 in order in this manner to ensure that the mixture of powder and carrying air emerges from the nozzles 6 only when these are in the lowered position.

In the case of the exemplary embodiment of the powder-dusting apparatus described with reference to FIGS. 2 to 4, a complete nozzle assembly, consisting of distributer pipe 7 and the nozzles 6, is moved vertically up and down. In this case a single flexible hose 16 which provides the connection between the mixing device 8 and the distributer pipe 7 is sufficient. Under some circumstances, in order to reduce the moving masses, it can be advantageous to secure the distributer pipe 7 fixedly to the machine frame and to move only the nozzles vertically up and down, which in this case are held together by a very light-weight connecting bar. In this embodiment of the invention a flexible hose leads from each nozzle to the distributer pipe.

Figure 5:
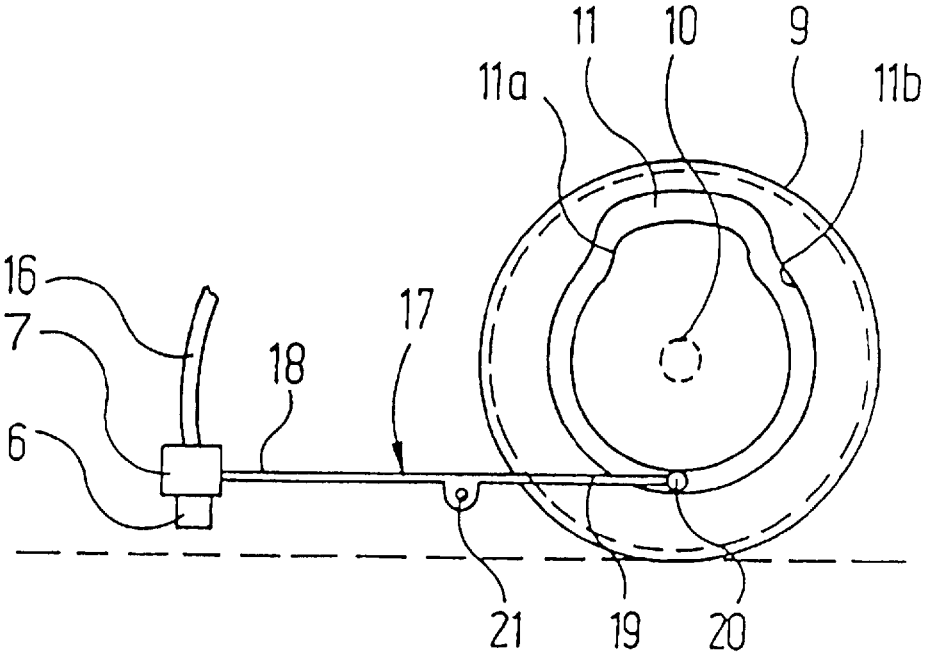
FIGS. 5 to 7 are diagrammatic representation of a further modified drive.

In the exemplary embodiment mentioned above, the movement of the nozzles between the two positions which they are able to assume relative to the plane of transport was linear. The control of the movement sequence in a further exemplary embodiment of the invention, which is illustrated in FIG. 5, is effected even more simply:

Here, the lifting device comprises a double-arm lever 17, on one arm 18 of which the nozzles 6 are arranged and the other arm 19 of which is driven by a cam surface 11*a*, 11*b*, for which purpose the arm engages with a drive pin 20 in the cam track 11. The lever 17 is mounted on a pin 21 secured to the machine frame. The chain wheel 9 turns the cam track 11 synchronously with the movement of the conveyor chains 1, and the nozzles consequently have imparted to them a pivoting movement from one position into the other position. As in the exemplary embodiments shown in FIGS. 2 to 5, the cam track 11 is mounted on the chain wheel 9, the circumference of which corresponds to the spacing of two successive gripping devices 2. The phase position of the chain wheel 9 is matched during installation to the phase position of the gripping devices 2, so that as a gripping device 2 passes by, it is possible to ensure that each nozzle 6 is lifted an adequate distance away from the path travelled by the printed products.

I claim:

1. Powder-dusting apparatus for a printing machine, having a transport system including gripping devices, a) a plurality of nozzles through which a mixture of powder and carrying air is directed towards printed products moved past by the gripping devices of the transport system of the printing machine;

b)a mixing device, in which the powder is mixed with air to produce the mixture of powder and carrying air;

c) at least one connecting line, which connects the mixing device with the nozzles, characterized by d) a lifting device (9 to 13) which is able to move the nozzles (6) back and forth between two positions, namely, da) a first position comparatively far removed from a plane of transport of the printed products and db) a second position lying comparatively close to the plane of transport of the printed products and e)a control means (11, 12) detecting the position of the gripping device (2), which control means co-operates with the lifting device (9 to 13) such that the latter brings the nozzles (6) into the first position as long as the gripping device (2) is in the Vicinity of the nozzles (6), and brings the nozzles (6) into the second position when the gripping device (2) is located an adequate distance from the nozzles (6).

2. Powder-dusting apparatus according to claim 1, characterised in that the lifting device and the control means are combined in a cam mechanism (9 to 13) which comprises:

a) at least one chain wheel (9) co-operating with a conveyor chain (1) of the transport system;

b) at least one inherently closed cam surface (11*a*, 11*b*) driven by the chain wheel (9);

c) at least one cam follower (12) connected to the nozzles (6), which co-operates with the cam surface (11*a*, 11*b*);

d) a guide means (13), which guides the nozzles (6) on the path between their two positions.

3. Powder-dusting apparatus according to claim 2, characterised in that two parallel cam surfaces (11*a*, 11*b*) are provided, which form a cam track (11) in which the cam follower (12) is received.

4. Powder-dusting apparatus according to claim 2, characterised in that only one cam surface is provided and the cam follower is pressed by a biassing device against the one cam surface.

5. Powder-dusting apparatus according to claim 1, characterised in that the lifting device is mechanically separated from the control means and the latter comprises at least a first sensor arranged at the plane of transport which, as a gripping device approaches the nozzles, supplies to the lifting device a first signal which causes the lifting device to bring the nozzle into the first position.

6. Powder-dusting apparatus according to claim 5, characterised in that the control means comprises a second sensor arranged at the plane of transport which, as a gripping device moves away, supplies a second signal to the lifting device which causes the lifting device to bring the nozzles into the second position.

7. Powder-dusting apparatus according to claim 5, characterised in that the control means contains a timing element which is triggered by the first signal of the first sensor and after a certain period has elapsed emits a second signal which is supplied to the lifting device and causes this to bring the nozzles into the second position.

8. Powder-dusting apparatus according to claim 1, characterised in that the nozzles (6) are rigidly connected to a distributer pipe (7) and with this form a movable unit which is connected by way of a flexible hose (16) to the mixing device (8).

9. Powder-dusting apparatus according to claim 1, characterised in that the nozzles are connected by means of a light-weight supporting bar to form a movable unit and each nozzle is connected by way of a flexible hose to a fixed distributer pipe, which in its turn is in connection with the mixing device.

10. Powder-dusting apparatus according to claim 1, characterised in that it comprises a sensor (15) which detects the position of the nozzles (6) and produces an output signal that causes the mixing device (8) to function only for as long as the nozzles (6) are located in the second position.

11. Powder-dusting apparatus according to claim 1, characterised in that the lifting device displaces the nozzles in a pivoting movement between the two positions.

12. Powder-dusting apparatus according to claim 11, characterised in that the lifting device comprises a one-armed or multi-armed lever which at a first point carries the nozzles (6) and which at a second point is engaged by a cam surface (11) driven synchronously with the speed at which the printed products are conveyed.

13. Powder-dusting apparatus according to claim 2, characterised in that the cam surface (11*a*, 11*b*) performs one revolution for advancement of the conveyor chain (1) by a distance that corresponds to the spacing of two successive gripping devices (2).

14. Powder-dusting apparatus according to claim 13, characterised in that the circumference of the chain wheel (9) corresponds to the spacing of successive gripping devices (2).

* * * * *